US008008604B2

(12) United States Patent
Tsang

(10) Patent No.: US 8,008,604 B2
(45) Date of Patent: Aug. 30, 2011

(54) LOW PROFILE HEATER

(75) Inventor: Him Chung Tsang, Kowloon (HK)

(73) Assignee: Honor Tone, Ltd., Shatin, New Territories (HK)

( * ) Notice: Subject to any disclaimer, the term of this patent is extended or adjusted under 35 U.S.C. 154(b) by 625 days.

(21) Appl. No.: 11/862,694

(22) Filed: Sep. 27, 2007

(65) Prior Publication Data

US 2009/0085713 A1 Apr. 2, 2009

(51) Int. Cl.
*F24H 1/10* (2006.01)

(52) U.S. Cl. ..... 219/494; 338/23; 219/496; 392/478

(58) Field of Classification Search ..... 219/494, 219/496, 497; 323/270; 338/23; 392/374; 365/202; 374/183, 184
See application file for complete search history.

(56) References Cited

U.S. PATENT DOCUMENTS 4,363,556 A * 12/1982 Belliveau et al. ..... 374/183
4,863,649 A 9/1989 Kawakubo et al.
4,916,292 A 4/1990 Kawakubo et al.
6,627,116 B1 9/2003 Suda et al.
6,627,144 B1 9/2003 Suda et al.
6,730,892 B2 5/2004 Suda et al.
2003/0077450 A1 4/2003 Suda et al.
2003/0222077 A1 12/2003 Suda et al.

FOREIGN PATENT DOCUMENTS

WO 9859526 A1 12/1998
WO 0251207 A1 6/2002

* cited by examiner

*Primary Examiner* — Henry Yuen
*Assistant Examiner* — Brian Jennison
(74) *Attorney, Agent, or Firm* — Patzik, Frank & Samotny Ltd.

(57) ABSTRACT

A portable, low profile electric radiant heater has an elongated heating element. A plurality of thermistors are disposed proximate to and along the length of the elongated heating element, spaced at substantially equal intervals. A microcontroller switches a reference resistor in series with a charging capacitor to determine a reference timer value. The microcontroller switches banks of multiple thermistors in series with the charging capacitor to determine associated timer values. The microcontroller calculates thermistor resistance values using the reference timer, reference resistor, and thermistor timer values. A lookup table is employed to determine a temperature value associated with the thermistor resistance value. This serves as the sensed temperature of the associated bank of thermistors. A plurality of tip-over switches are provided. One tip-over switch is disposed between the microcontroller and the heating element. Another tip-over switch is disposed between the microcontroller and the banks of temperature sensing thermistors.

7 Claims, 9 Drawing Sheets

LOW PROFILE HEATER

FIELD OF INVENTION

The present invention relates, in general, to electric space heaters, and, specifically, to portable electric heaters.

DESCRIPTION OF RELATED ART

In the past, electric heaters were permanently installed into homes and businesses, by permanently attaching the heater to a baseboard region of a wall, and permanently wiring the heater into the home or business' electrical system. More recently, portable electric heaters, such as baseboard type heaters, have become popular. Such portable systems are used to either warm unheated spaces, or to augment the heating of spaces which are insufficiently heated by existing, built-in heating systems. Such portable electric baseboard heaters, while elongated, are typically relatively lightweight and portable. They typically include a conventional power cord and 3-prong electrical plug, for attachment to conventional AC outlets. Such heaters are typically designed to warm relatively small interior regions, on the order of a few hundred square feet in size or smaller.

BRIEF SUMMARY OF INVENTION

The present invention comprises a low profile, portable electric heater apparatus. The heating apparatus has a heating element having a longitudinal axis, at least one thermistor, a reference resistor a capacitor; and a microcontroller. The microcontroller has port pins coupled to the at least one thermistor and the reference resistor. The microcontroller is capable of switching the direction of the port pins between input and output to alternatively and selectively place the reference resistor and the at least one thermistor in series with the capacitor to form two separate RC timing circuits.

In a preferred embodiment, the portable electric heater apparatus further includes an ambient temperature sensor, and the port pins are coupled to the at least one thermistor, the reference resistor, and the ambient temperature sensor. The microcontroller is capable of switching the direction of the port pins between input and output to alternatively and selectively place the reference resistor, the at least one thermistor, and the ambient temperature sensor in series with the capacitor to form three separate RC timing circuits.

Moreover, in a preferred embodiment, the at least one thermistor comprises a plurality of thermistors spaced at substantially even intervals along a line substantially parallel to the longitudinal axis of the heating element. Moreover, the at least one thermistor preferably comprises a plurality of thermistors, the plurality of thermistors being grouped into at least two banks, each bank having at least two thermistors wired in parallel. The microcontroller is capable of switching the direction of the port pins between input and output to selectively place each bank of thermistors in series with the capacitor to form two separate RC timing circuits.

In a preferred embodiment, the present portable electric heating apparatus has a housing having a substantially upright orientation, a heating element disposed within the housing, a power source coupled to the heating element; and at least one tip-over switch serving to disconnect the heating element from the power source when the housing is not in the substantially upright orientation. Moreover, in a preferred embodiment, the at least one tip-over switch comprises at least two tip-over switches, including a first tip-over switch and a second tip-over switch. The apparatus further includes a relay, at least one temperature sensor, and a microcontroller.

The relay has a closed and a normally open position, and is coupled to the heating element and the power source, such that the heating element is connected to the power source when the relay is in the closed position and is disconnected from the power source when the relay is in the normally open position. An output pin of the microcontroller switches the relay between the closed and normally open positions, through an intermediate transistor.

The first tip-over switch is disposed between the microcontroller and the relay and disconnects the microprocessor from the relay when the housing is not in the substantially upright orientation and, in turn, switches the relay to the normally open position. Moreover, the second tip-over switch is disposed between the microcontroller and the at least one temperature sensor, permitting the microprocessor to sense an abnormal condition when attempting to read the temperature sensor when the housing is not in the substantially upright orientation.

The present invention also comprises a method of sensing an overheating condition in a portable electric heater. The portable electric heater has a heating element, a reference resistor having a known resistance of R_Reference, at least one thermistor disposed proximate the heating element, and a capacitor. A reference resistor is placed in series with the capacitor to form a first RC timing circuit. An amount of time TIMER_Reference that it takes for a point between the reference resistor and the capacitor to reach a predetermined threshold voltage is determined. The at least one thermistor is placed in series with the capacitor to form a second RC timing circuit. An amount of time TIMER_BANK#1 that it takes for a point between the at least one thermistor and the capacitor to reach a predetermined threshold voltage is determined. A resistance value R_BANK#1 corresponding to the at least one thermistor is determined using the following equation:

$$\frac{\text{R_Referemce}}{\text{TIMER_Reference}} = \frac{\text{R_Bank \#1}}{\text{TIMER_Bank \#1}};$$

Next, a table lookup of a temperature value corresponding to R_BANK#1 is performed. A test, or comparison to determine if the temperature value is indicative of an overheating condition is then performed.

In a preferred embodiment, the step of determining an amount of time TIMER_Bank#1 that it takes for a point between the at least one thermistor and the capacitor to reach a predetermined threshold voltage comprises is performed by a) determining an amount of time TIMER_Bank#1_Sample that it takes for a point between the at least one thermistor and the capacitor to reach a predetermined threshold voltage; b) storing TIMER_Bank#1_Sample in memory; c) discharging the capacitor; repeating steps a through c until a plurality of TIMER_Bank#1_Sample values are stored in memory; and then averaging at least two of the TIMER_Bank#1_Sample values to obtain the TIMER_Bank#1 value. Moreover, the step of averaging at least two of the TIMER_Bank#1_Sample values to obtain the TIMER_Bank#1 value comprises the sub-steps of discarding a TIMER_Bank#1_Sample value having a maximum value; discarding a TIMER_Bank#1_Sample value having a minimum value; and averaging the remaining TIMER_Bank#1_Sample values stored in memory. In a preferred embodiment, a total of eighteen TIMER_Bank#1_Sample values are stored in memory, and a total of sixteen TIMER_Bank#1_Sample values are averaged.

Moreover, the step of determining an amount of time TIMER_Reference that it takes for a point between the reference resistor and the capacitor to reach a predetermined threshold voltage preferably comprises the sub-steps of: a) determining an amount of time TIMER_Reference_Sample that it takes for a point between the reference resistor and the capacitor to reach a predetermined threshold voltage; b) storing TIMER_Reference_Sample in memory; c) discharging the capacitor; repeating steps a through c until a plurality of TIMER_Reference_Sample values are stored in memory; and averaging the values of at least two of the TIMER_Reference_Sample values to obtain the TIMER_Reference value. The step of averaging at least two of the TIMER_Reference_Sample values to obtain the TIMER_Reference value preferably comprises the sub-steps of: discarding a TIMER_Reference_Sample value having a maximum value; discarding a TIMER_Reference_Sample value having a minimum value; and averaging the remaining TIMER_Reference_Sample values stored in memory. A total of eighteen TIMER_Reference_Sample values are preferably stored in memory, and a total of sixteen TIMER_Reference_Sample values are preferably averaged.

DETAILED DESCRIPTION OF INVENTION

Figure 1:
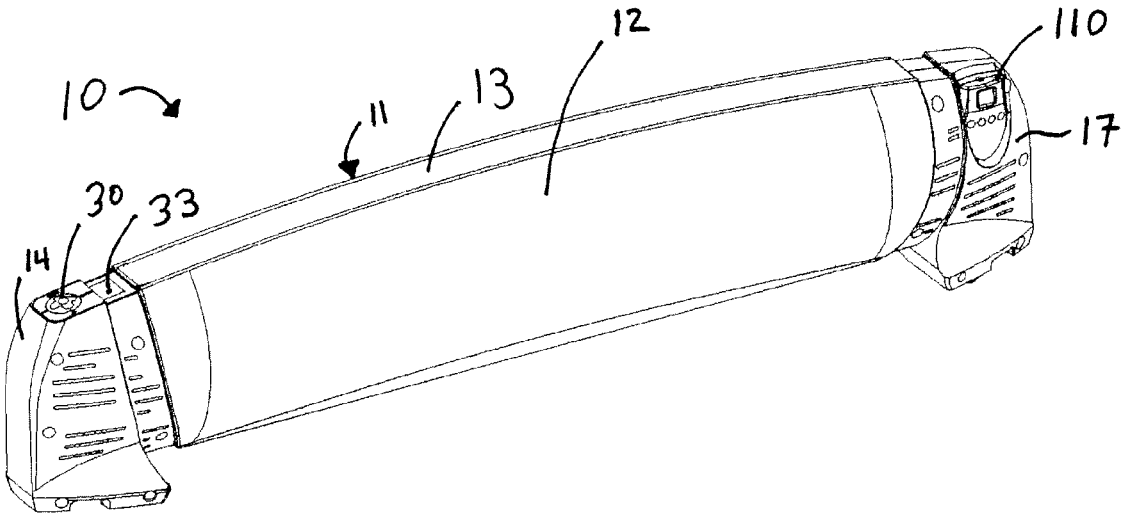
FIG. 1 is an elevated perspective view of the present heater apparatus.
Figure 2:
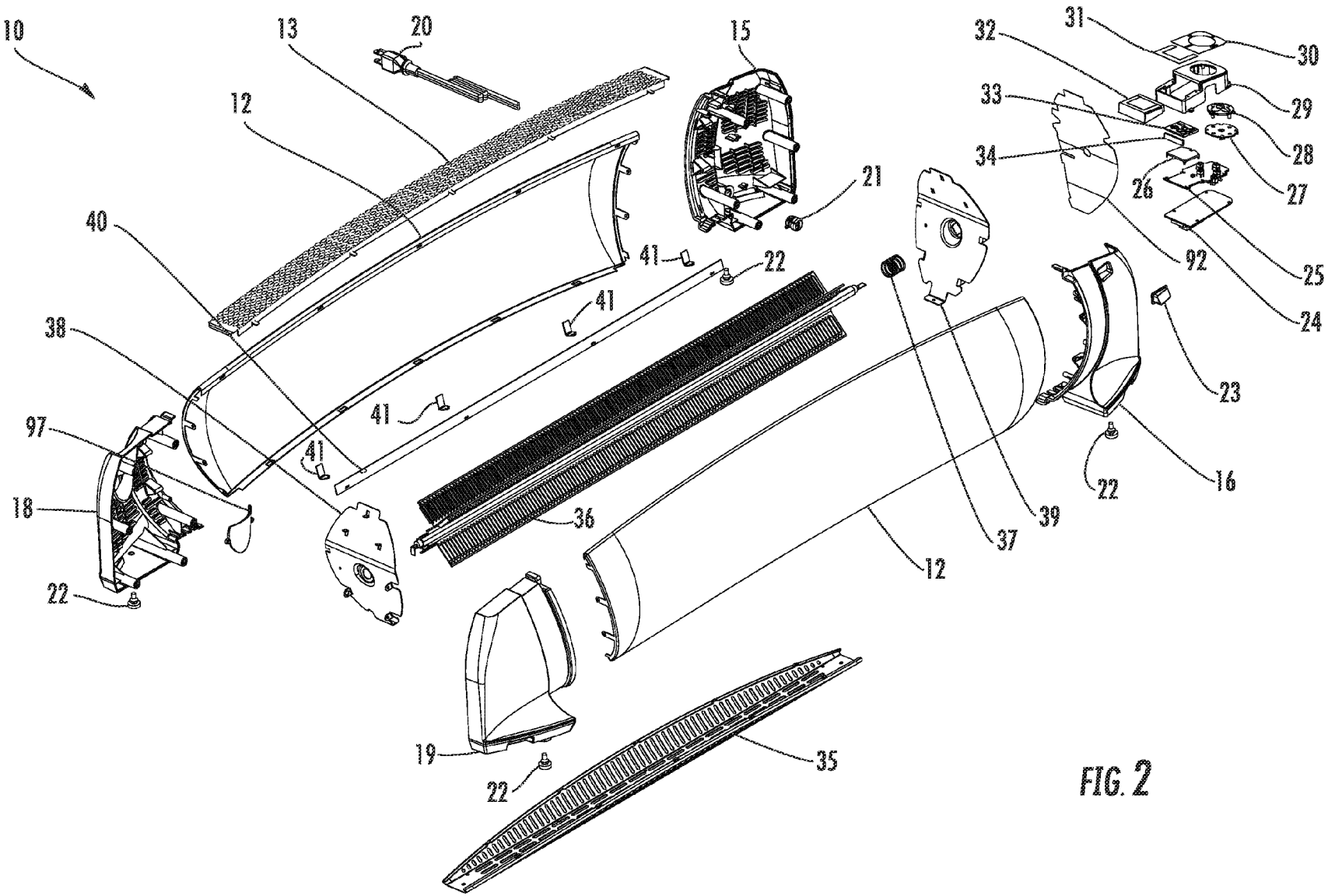
FIG. 2 is an exploded perspective view of the present heater apparatus.

The present low profile heater apparatus 10 is shown in FIGS. 1 and 2 as comprising housing 11 which, in turn, comprises two elongated metallic plates 12, top ventilation grille 13, bottom ventilation grille 35, and end caps 14, 17. End cap 14 includes mating end cap halves 15 and 16. End cap 17 includes mating end cap halves 15 and 16. Each end cap half includes a rubber foot 22 attached to a bottom surface and supporting the end cap and, in turn, the overall heater apparatus, and serving to help maintain the apparatus in a substantially upright orientation. A power cord 20, terminating in a standard power plug, is disposed through a corresponding aperture in end cap half 15. A strain relief grommet 21 inhibits movement of power cord 20 through this aperture. An aperture in end cap half 16 permits infrared ("IR") remote control signals to be received by an IR receiver disposed within housing 11 proximate this aperture. A translucent IR receiver cover 23 covers this aperture. Remote mount 97 permits remote control unit 110 to be releasably secured to end cap 17.

Within housing 11, an elongated electric heating element 36 extends along a longitudinal axis of the housing. In a preferred embodiment, to facilitate the distribution of radiant heat energy, heating element 36 includes four of sets of blades, or fins, radiating from a longitudinal axis of the heating element, at ninety degree angles, relative to each other, and being substantially "X"-shaped in cross section. Heating element 36 is held in place within housing 11 by two opposing insulating plates 38, 39, each of which has an aperture accepting an opposing end of heating element 36. Each insulation plate is, in turn, held within cooperating recesses in the interior surfaces of the end caps. A stainless steel spring 37 further secures heating element 36 between insulating plates 38 and 39.

An elongated temperature limit control printed circuit board ("PCB") 40 is also disposed within housing 11, parallel to the longitudinal axis of the heating element and in close proximity to heating element 36 and along a significant portion of the length of heating element 36. A plurality of affixation plates 41 secure PCB 40 within housing 11 proximate heating element 36.

A mica plate 92 is disposed within housing 11 and held in place between end cap halves 15 and 16 of end cap 14. Mica plate 92 electrically insulates the control components of the present low profile heater apparatus, contained within end cap 14, from insulation plate 39.

As shown in FIG. 2, these control components include power supply PCB 24, control PCB 25, Liquid Crystal Display "LCD" backlight 26, control button mount 27, control button assembly 28, PCB housing cover 29, control overlay 30, LCD overlay 31, LCD cover 32, LCD display 33, and elastomeric connector 34.

Figure 3:
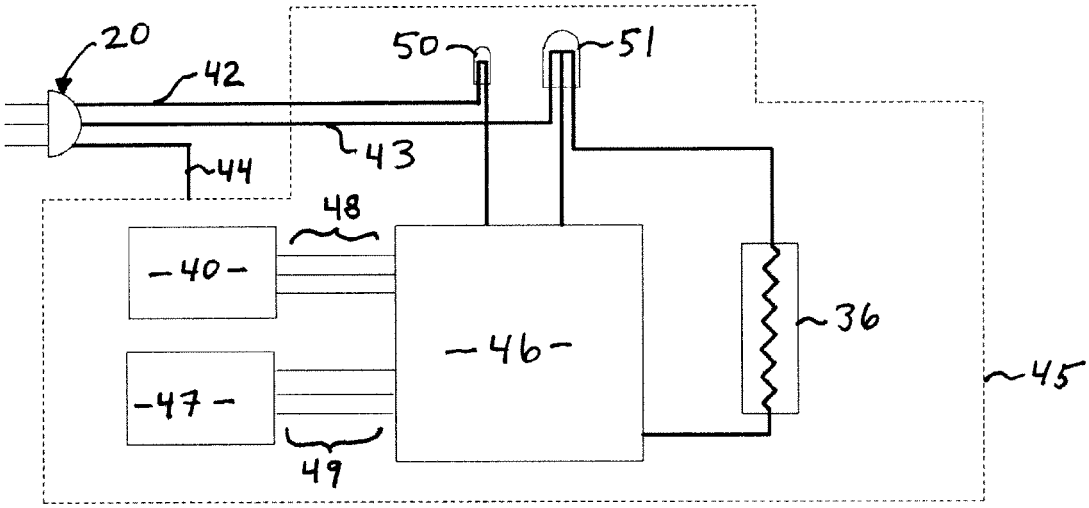
FIG. 3 is a wiring diagram of the present heater apparatus.

A wiring diagram of the control components is shown in FIG. 3. A metallic enclosure 45 portion of the housing is coupled to earth ground conductor 44 of power cord 20. Alternating Current ("AC") line conductor 42 is coupled to control PCB 46 using cap nut 50. AC neutral conductor 43 is coupled to control box 46 using cap nut 51. A printed circuit card containing first tip-over switch 47 is coupled to control PCB 46 via ribbon cable 49. Temperature limit control PCB 40 is coupled to control PCB 46 via ribbon cable 48. Heating element 36 is connected is connected in series between control PCB and AC neutral conductor 43 using cap nut 51.

Figure 4:
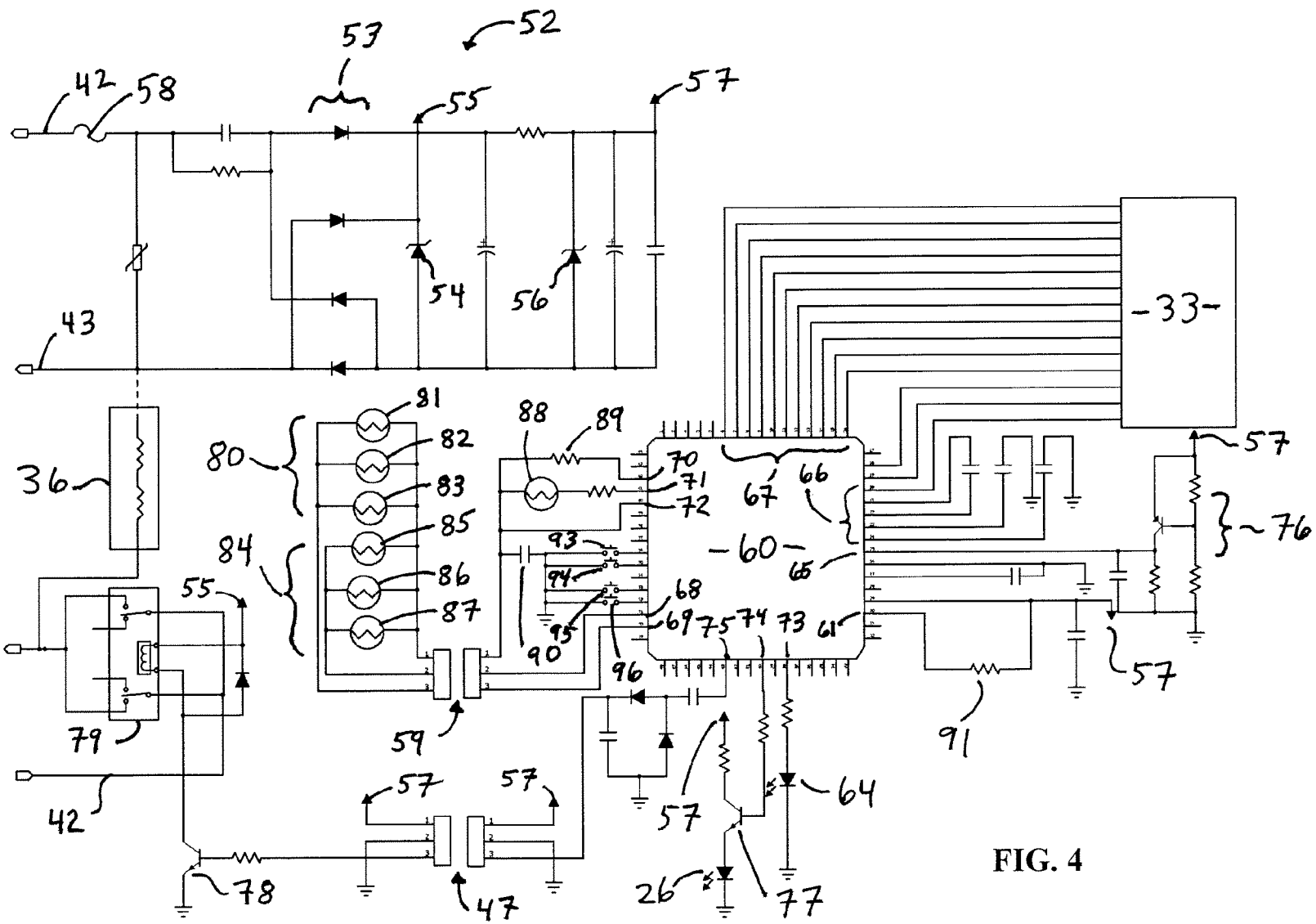
FIG. 4 is a schematic diagram of the present heater apparatus.

A schematic diagram of the present low profile heater apparatus is shown in FIG. 4. A power supply 52, protected by fuse 58, is coupled to AC line conductor 42 and AC neutral conductor 43. Power supply 52 includes full wave bridge rectifier diodes 53, 24V zener diode 54, and 5.1V zener diode 56. Power supply 52 outputs 24V DC voltage 55 and 5.1V DC voltage 57.

Microcontroller 60 controls the overall operation of the present heater apparatus. In a preferred embodiment, microcontroller 60 comprises an EM78P468NH 8-bit microcontroller, manufactured by Elan Microelectronics Corp. of Hsinchu, Taiwan R.O.C. Microcontroller 60 preferably includes an 8-bit Reduced Instruction Set ("RISC") processor, with on-chip watchdog timer, data memory, program memory, programmable real time clock counter, bi-directional data, tri-state input/output ("I/O") ports, and LCD drivers. A precision resistor 91 is coupled to XIN pin 61 of the microcontroller and cooperates with a temperature compensating capacitor within microcontroller 60 to provide a time base, or clock for operation of the microcontroller.

A power-on reset circuit 76, with residual voltage protection, is coupled to external reset pin 65 of the microcontroller. A plurality of capacitors are coupled to the LCD bias voltage pins 66 of the microcontroller. LCD control output pins 67 of microcontroller 60 are coupled directly to LCD display 33. Power-on Light Emitting Diode ("LED") 64 is coupled to I/O port pin 73 of the microcontroller, and is accordingly under software control. Transistor driver 77 and LCD backlight 26 are coupled to I/O port pin 74 of the microcontroller, enabling microcontroller 60 to turn the backlight on and off under software control. In a preferred embodiment, microcontroller 60 turns off the LCD backlight after a predetermined delay, such as eight seconds, following each user input.

Heating element control I/O port pin 75 permits microcontroller 60 to turn heating element 36 on and off under software control, by switching the digital signal output by this pin between high and low logic levels. First tip-over switch 47 is wired between heating element control I/O port pin 75 and the base of transistor driver 78. The collector of transistor driver 78 is, in turn, coupled to the coil of normally open relay 79. Whenever first tip-over switch 47 is electrically closed, microcontroller 60, via heating element control I/O port pin 75, is able to switch transistor 78 to, in turn, energize the coil of relay 79. This, in turn, closes relay 79, and completes a circuit between AC line conductor 42, heating element 36, and AC neutral conductor 43. This, in turn, causes heating element 36 to produce and radiate heat.

Control button assembly 28 (FIG. 2) includes four normally open, momentary pushbutton switches. As shown in FIG. 4, each of these switches, including "Up" button 93, "Down" button 94, "Power/On" button 95 and "Mode" button 96, are coupled between ground and a dedicated I/O input port pin of microcontroller 60. This permits software contained within on-chip read-only memory of microcontroller 60 to determine the open or closed state of each switch, by periodically polling or sampling the I/O port associated with these dedicated I/O port pins.

Temperature limit control PCB 40 (FIG. 2) includes six Negative Temperature Coefficient ("NTC") thermistors disposed at substantially evenly spaced intervals (i.e., substantially equidistant from each other) along the length of the PCB. As shown in FIG. 4, these include thermistors 81, 82, 83, 85, 86, and 87. Each of these thermistors preferably comprises a glass sealed NTC thermistor rated at 500K ohm+/−3% zero power resistance, with a material coefficient B value of 4260K+/−1%.

As shown in FIG. 4, these six thermistors are electrically grouped into two banks of three thermistors each. First conductors of all six thermistors are coupled together and, through second tip-over switch 59, are coupled to heating element thermistor I/O input port pin 72 of microcontroller 60. Thermistors 81, 82 and 83 collectively comprise a first bank of thermistors 80, and the second conductors of all three of these thermistors are coupled together and, through second tip-over switch 59, are coupled to thermistor bank #1 control I/O port pin 69 of microcontroller 60. Likewise, thermistors 85, 86 and 87 collectively comprise a second bank of thermistors 84, and the second conductors of all three of these thermistors are coupled together and, through second tip-over switch 59, are coupled to thermistor bank #2 control I/O port pin 68 of microcontroller 60.

Through the use of a plurality of thermistors, regularly spaced along the heating element and in close proximity thereto, an over-temperature condition occurring substantially anywhere along the length of the heating element will be sensed by at least one of the thermistors, resulting in a prompt system shutdown of the present low profile heater apparatus.

The organization of the six thermistors into two banks, relative to microcontroller 60, has the advantage of permitting all six thermistors to be sensed, without having to individually couple each transistor input and output to a dedicated I/O pin of the microcontroller. This reduces the overall I/O pin requirement of the microcontroller, or the number of pins which must be dedicated for thermistor sampling. Accordingly, this leaves additional I/O pins available for other functions. Moreover, the use of banks of thermistors permits multiple thermistors to be sampled simultaneously by the microcontroller, speeding the sampling cycle for the total number of thermistors.

The use of two separate tip-over switches, at two different locations in the overall circuitry, is considered to provide an added level of safety. As shown in FIG. 4, first tip-over switch 47, disposed between microcontroller 60 and transistor 78, will always shut off heating element 36 upon a tip-over of the apparatus from its normal, substantially upright orientation (i.e., resting upon its rubber feet), without any requirement for intervention by microcontroller 60 (and, indeed, even if microcontroller 60 is malfunctioning). Second tip-over switch 59 is disposed between microcontroller 60 and both first thermistor bank 80 and second thermistor bank 84. Accordingly, as microcontroller 60 attempts to place these banks of thermistors in series with capacitor 90, microcontroller 60 is able to recognize an open condition of second tip-over switch 59, in that no valid thermistor timing value can be determined at I/O port pin 72. This is considered by microcontroller 60 to be an abnormal condition, indicative of the apparatus housing being other than in its normal, substantially upright position. Microcontroller 60 accordingly performs an automatic system shutdown as a safety precaution.

Reference resistor 89, which preferably comprises a 51K ohm, 1% precision resistor, is coupled between reference resistor control I/O port pin 70 of microcontroller and capacitor 90. Ambient temperature sensing thermistor 88 is coupled between ambient thermistor control I/O port pin 71 (through an intermediate resistor) and capacitor 90. Ambient temperature sensing thermistor 88 preferably comprises an epoxy sealed NTC thermistor rated at 50K ohm+/−3%, with a material coefficient B value of 3590K+/−1%.

By controlling the direction and state of I/O port pins 70, 71, 68 and 69, microcontroller 60 can separately place capacitor 80 in series with: reference resistor 89, ambient temperature sensing thermistor 88, second thermistor bank 84, and first thermistor bank 80, respectively.

First tip-over switch 47 and second tip-over switch 59 may be of the ball-rolling or mercury (or other conductive fluid-containing) variety, and are both oriented on printed circuit boards within the present apparatus such that they are electrically closed whenever the apparatus is in its proper, vertical orientation, resting upon all four rubber feet. Whenever the apparatus is tipped on its side, is upside down, or is otherwise oriented other than substantially vertical, tip-over switches 47 and 59 transition to an electrically open state, and remain so until proper orientation of the apparatus is restored.

Figure 5:
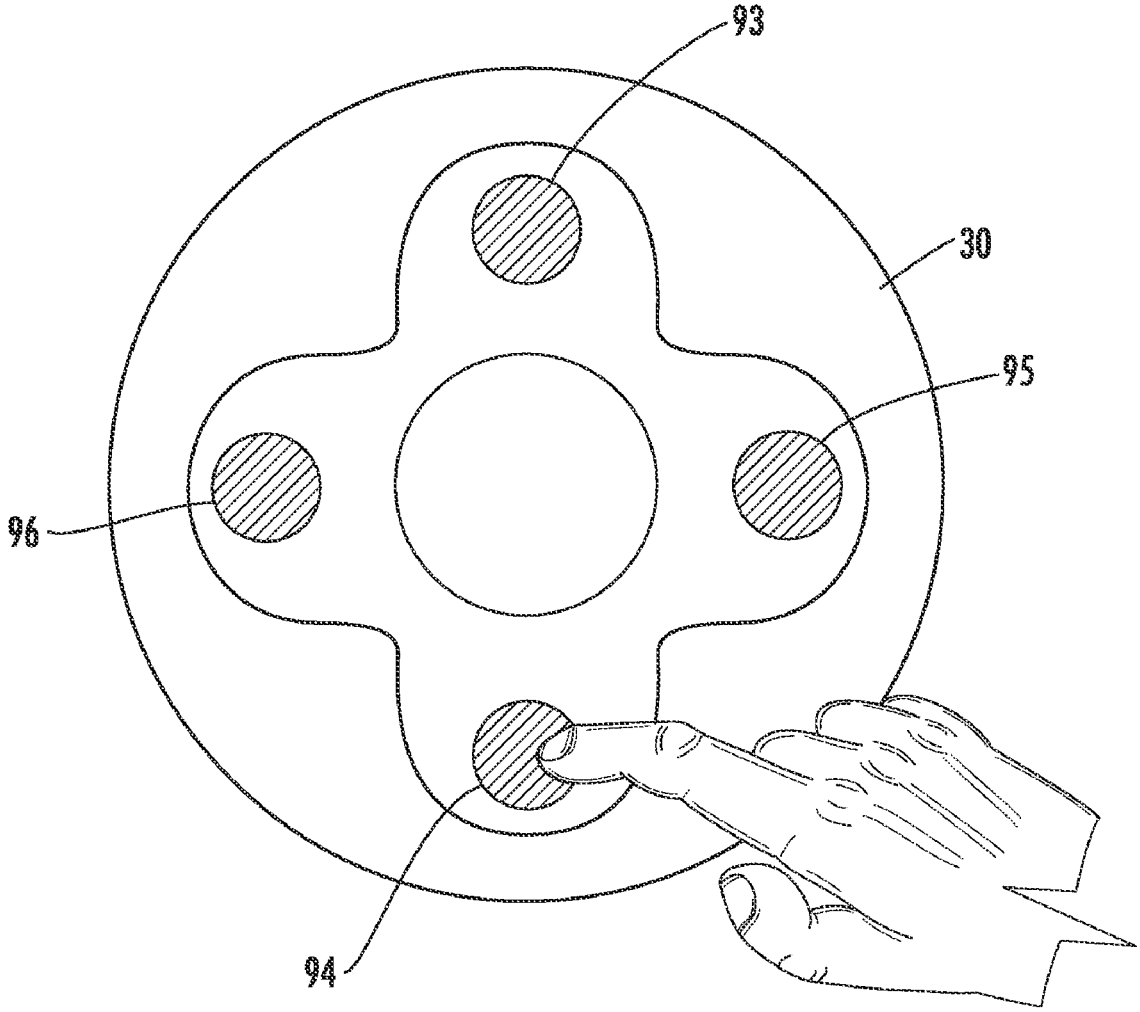
FIG. 5 is an enlarged view of the control button assembly.
Figure 6:
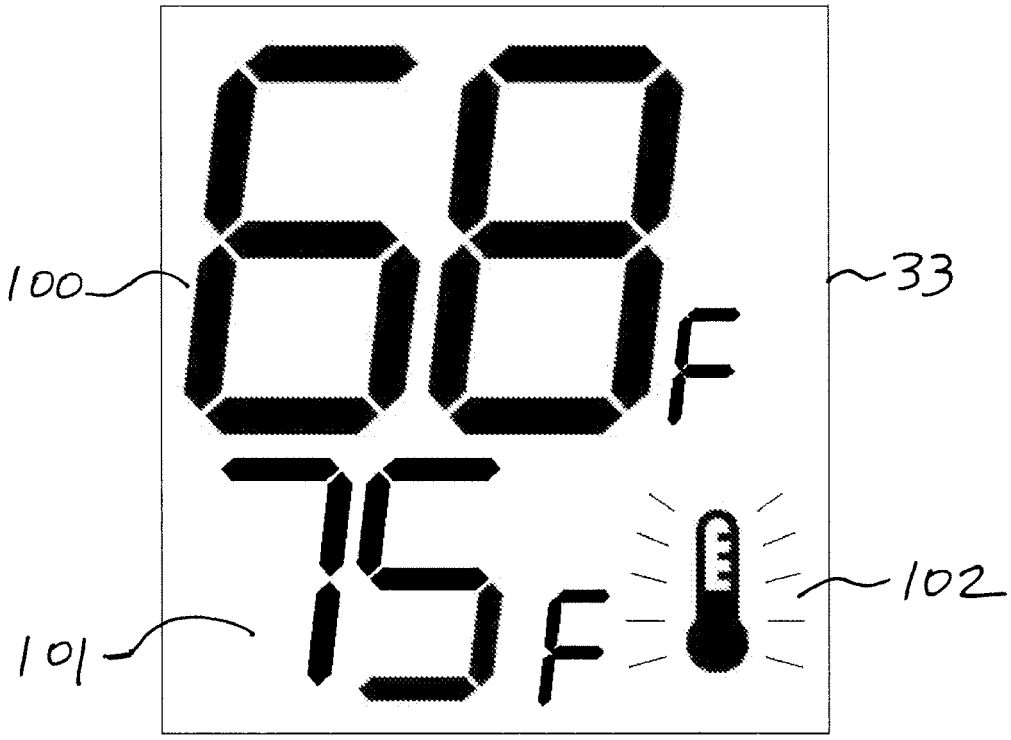
FIG. 6 is an enlarged view of the LCD display in temperature setting mode.

As shown in FIG. 5, control overlay 30 provides user access to pushbutton switches 93, 94, 95 and 96. Pushing On button 95 causes the low profile heater apparatus to turn on and off, in that microcontroller 60 is always monitoring this button, even when the apparatus is in the off state. Upon power on, following system initialization, the microcontroller activates the power-on LED, and illuminates the LCD backlight for eight seconds. LCD display 33 is initially placed in temperature setting mode, as shown in FIG. 6, as indicated by temperature mode icon 102, with LCD display 33 displaying the current ambient temperature 100 (as sensed by the ambient temperature sensing thermistor), and the target temperature 101 (which initializes to a default value of 75 degrees Fahrenheit). When in temperature setting mode, pressing Up button 93 causes the displayed target temperature 101 to increase by one degree. Conversely, when in temperature setting mode, pressing Down button 94 causes the displayed target temperature 101 to decrease by one degree. By repeatedly pressing the Up or Down buttons, any desired target temperature between 55 and 85 degrees Fahrenheit may be set by the user. Upon each sensed keypress, the microcontroller activates the LCD backlight for eight seconds.

Figure 7:
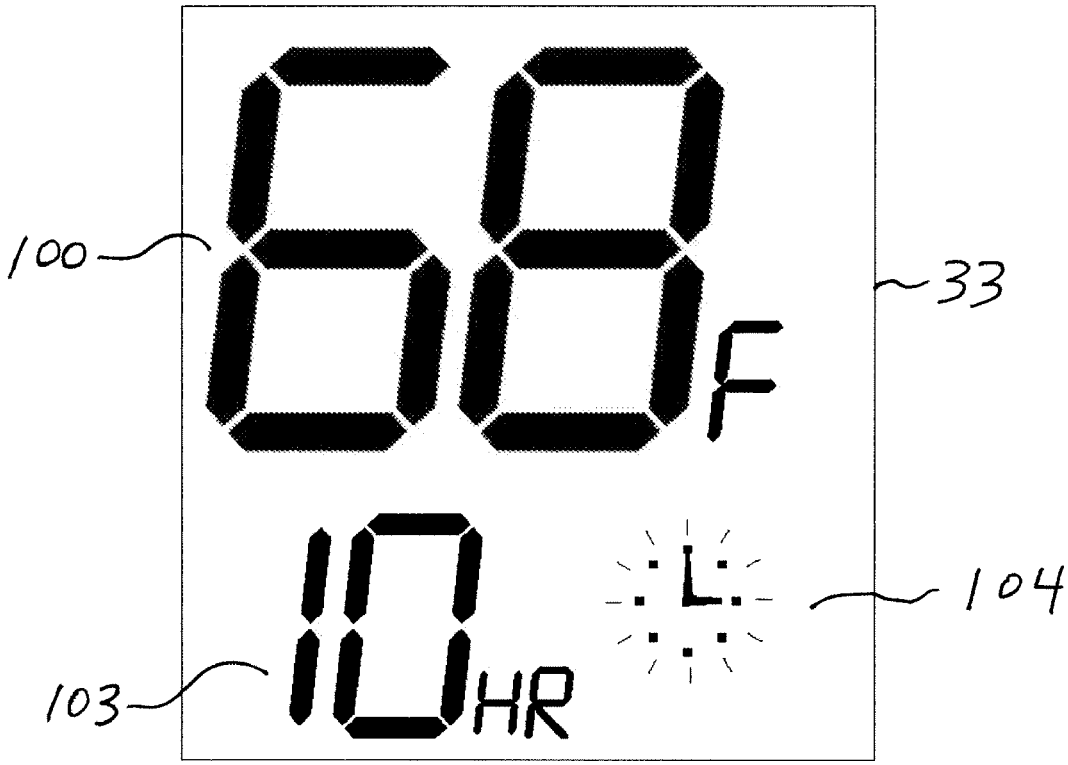
FIG. 7 is an enlarged view of the LCD display in timer setting mode.

Pressing Mode button 96 causes the apparatus to switch between temperature setting and timer modes. When in timer mode, as shown in FIG. 7, LCD display 33 presents a timer mode icon 104. As in temperature setting mode, the current sensed ambient temperature 100 is displayed. Moreover, timer mode permits the user to set an automatic shutoff countdown timer. When in timer mode, pressing Down button 94 causes the displayed timer duration 103 to decrease by one hour. Pressing Up button 93 causes the displayed timer duration 103 to increase by one hour. By repeatedly pressing the Up or Down buttons, any desired turnoff time, from one to ten hours, may be set by the user. Upon each sensed keypress, the microcontroller activates the LCD backlight for eight seconds. An internal real-time clock within the microcontroller is employed to determine when the desired shutoff time is reached, and to automatically power down the apparatus upon the expiration of the user-set turnoff time period.

Figure 8:
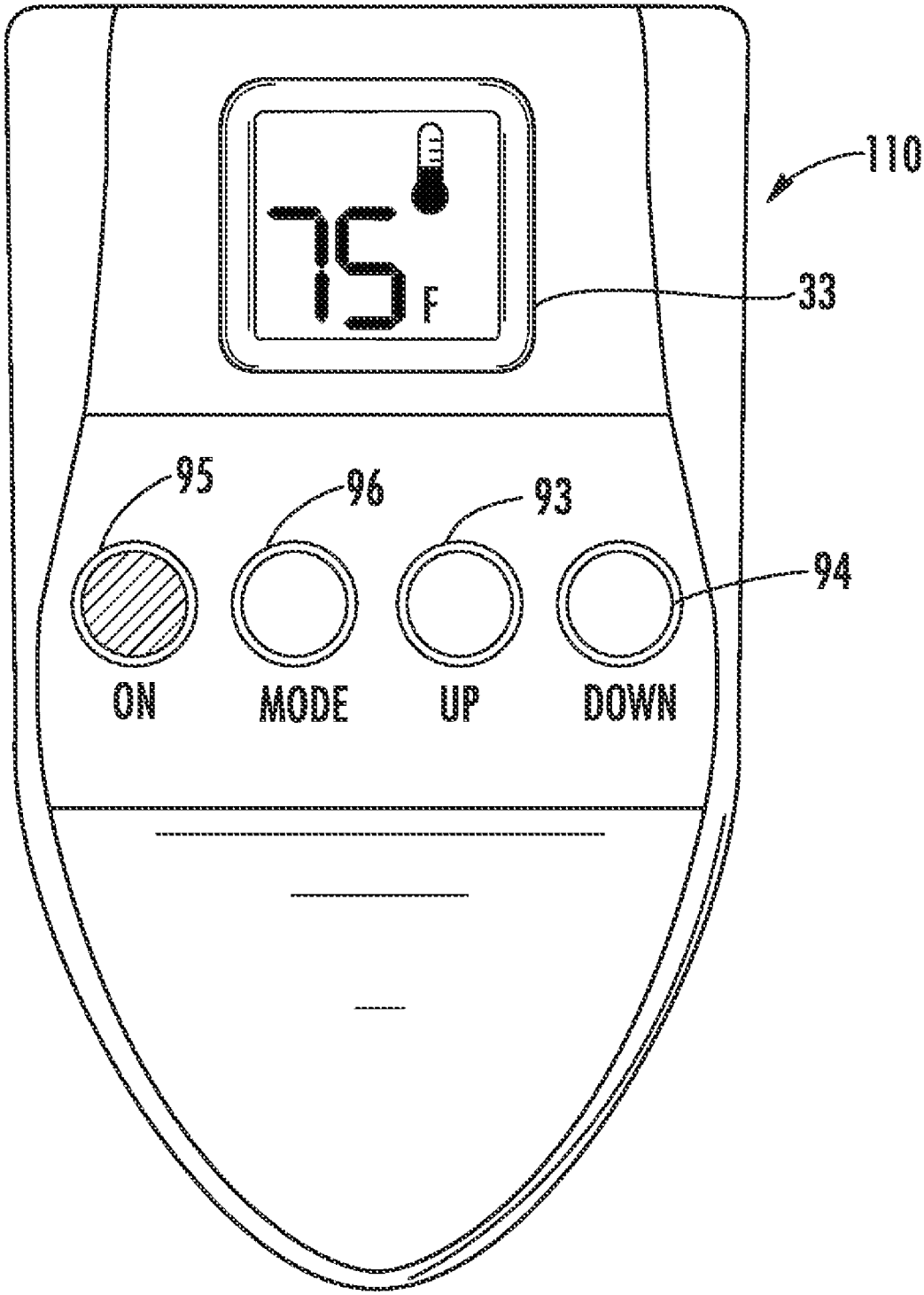
FIG. 8 is a top plan view of the remote control unit.

As shown in FIG. 1, a remote control unit 110 may be stored within a cooperating recess of end cap 17 of housing 11. Remote control unit 110 is shown in detail in FIG. 8 as including a separate LCD display 33, and separate Up, Down, On and Mode buttons 93, 94, 95 and 96, respectively. Remote control unit 110 contains its own microcontroller, and an IR transmitter, which, in response to user keypresses, transmits corresponding IR signals for receipt by an IR receiver, coupled to the microcontroller within the main apparatus housing. This, in turn, permits remote operation of all of the user input functions of the apparatus, as well as remote display of all of the information displayed on the LCD display in the main apparatus housing.

Figure 9A:
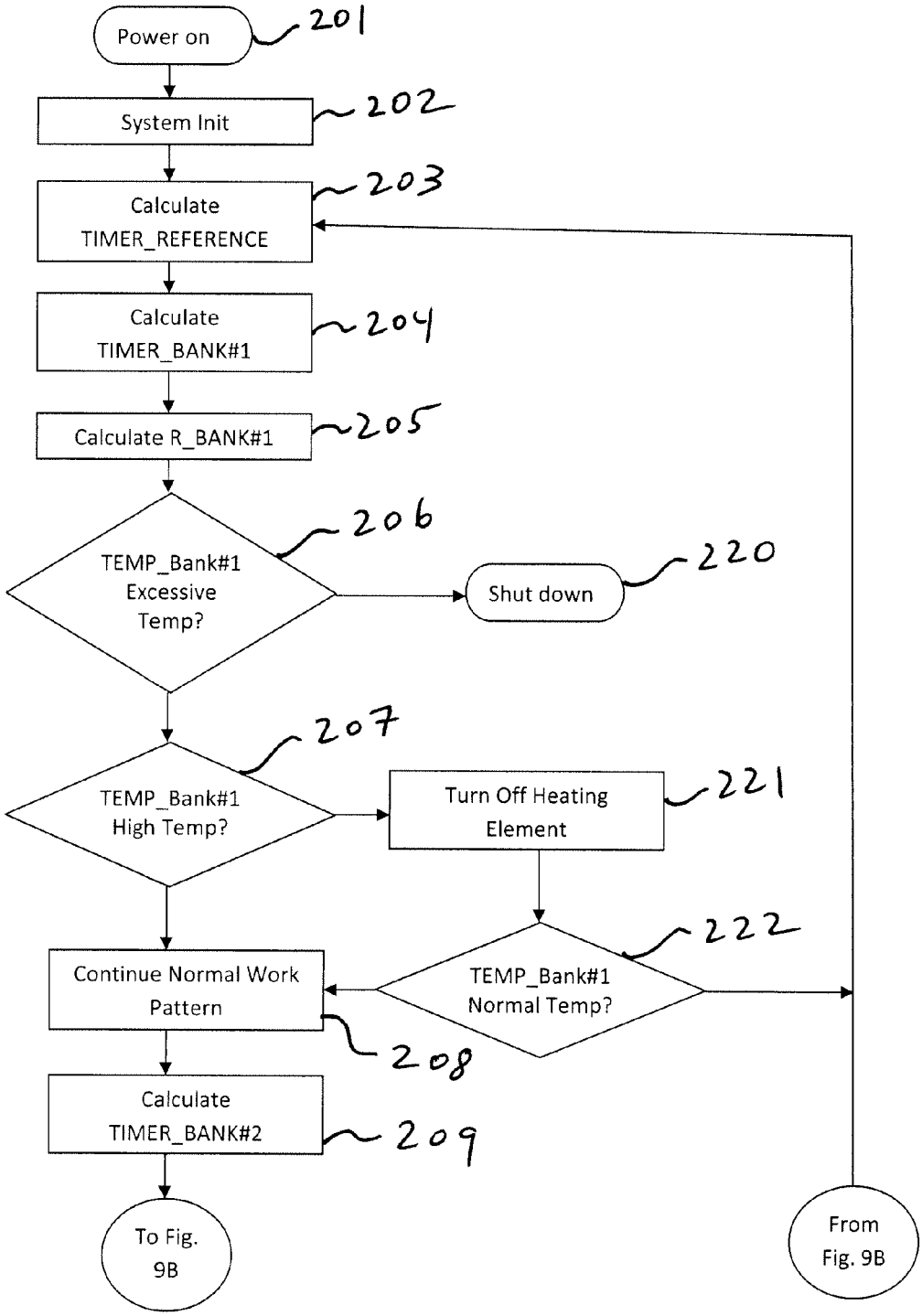
FIGS. 9A-9C, collectively referred to as FIG. 9, is a flowchart of certain operations performed by the circuitry and microcontroller of the present heater apparatus.
Figure 9B:
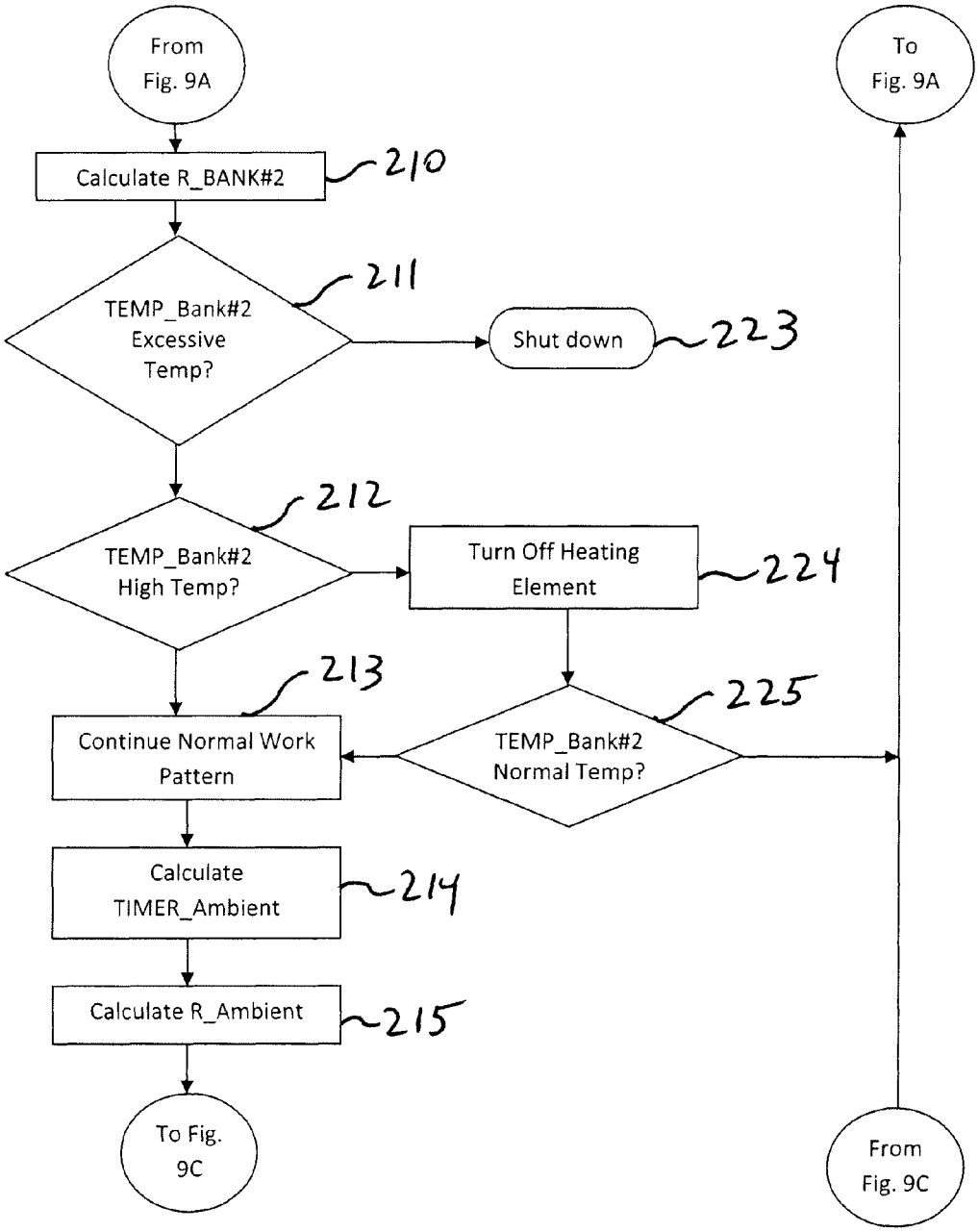
Figure 9C:
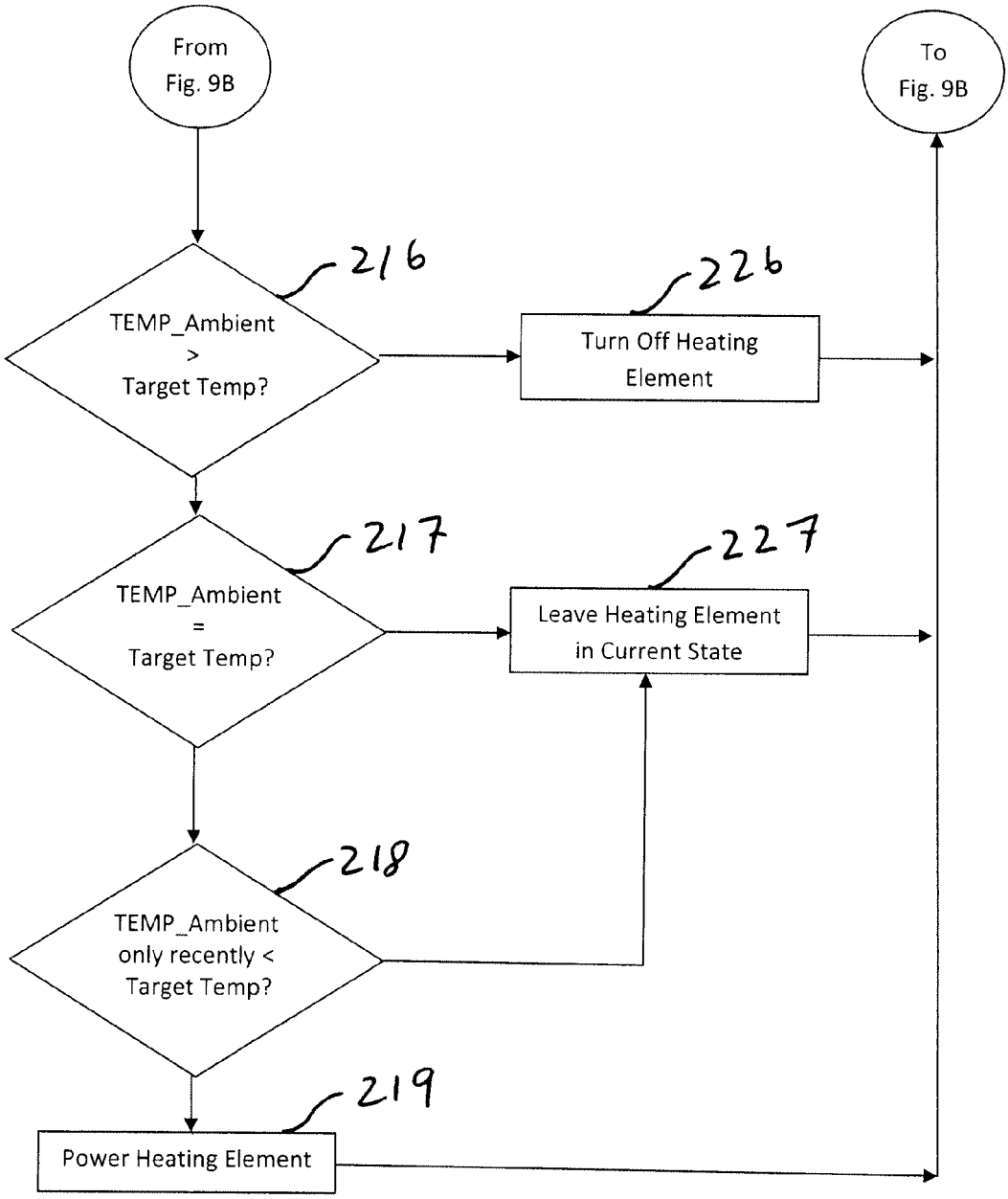

A flowchart of certain operations performed by the circuitry and microcontroller of the present heater apparatus is shown in FIG. 9. At step 201, a power-on condition occurs, by the user pressing the On button, either on the main apparatus housing, or on the remote control. Next, in step 202, the microcontroller performs system initialization, and sets the default desired ambient air temperature to 75 degrees Fahrenheit.

Next, at step 203 of FIG. 9, and referring to the schematic of FIG. 4, microcontroller 60 determines a reference time constant, TIMER_Reference, corresponding to the RC charging circuit of capacitor 90 in series with reference resistor 89, forming an RC timing circuit. In particular, microcontroller 60 sets I/O port pin 70 to the output state, and I/O port pins 71, 72, 68 and 69 to the input state. Microcontroller 60 then activates an internal timer, and continuously monitors I/O port pin 72 while capacitor 90 charges, until a low-to-high logic level transition on this pin is observed (i.e., until a predetermined, logic "1" threshold voltage is reached). The value of the internal timer at the time of this transition, TIMER_Reference_Sample, is stored in internal memory, and the microcontroller sets I/O pins 70, 71, 72, 68 and 69 all to a logic low output level for one millisecond, to permit capacitor 90 to discharge. This operation of repeatedly charging capacitor 90 through reference resistor 89, timing how long it takes for a logic high level to be reached, storing this TIMER_Reference_Sample in memory, and then discharging the capacitor, is repeated seventeen more times, until eighteen contiguous timer value samples are stored in the memory of Microcontroller 60. Of these eighteen timer samples, the maximum and minimum values are discarded, and the mean, or average of the remaining sixteen samples is calculated by microcontroller 60 to be the reference time constant, TIMER_Reference.

Next, at step 204 of FIG. 9, and referring to the schematic of FIG. 4, microcontroller 60 determines a thermistor bank #1 time constant, TIMER_Bank#1, corresponding to the RC charging circuit of capacitor 90 in series with the parallel-wired bank of three thermistors in first thermistor bank 80, comprising thermistors 81, 82 and 83, thus forming an RC timing circuit. In particular, microcontroller 60 sets I/O port pin 69 to the output state, and I/O port pins 70, 71, 72, and 68 to the input state. Microcontroller 60 then activates an internal timer, and continuously monitors I/O port pin 72 while capacitor 90 charges, until a low-to-high logic level transition on this pin is observed. The value of the internal timer at the time of this transition, TIMER_Bank#1_Sample, is stored in internal memory, and the microcontroller sets I/O pins 70, 71, 72, 68 and 69 all to a logic low output level for one millisecond, to permit capacitor 90 to discharge. This operation of repeatedly charging capacitor 90 through first thermistor bank 80, timing how long it takes for a logic high level to be reached, storing this TIMER_Bank#1_Sample value in memory, and then discharging the capacitor, is repeated seventeen more times, until eighteen contiguous timer value samples are stored in the memory of Microcontroller 60. Of these eighteen timer samples, the maximum and minimum values is discarded, and the mean, or average of the remaining sixteen samples is calculated by microcontroller 60 to be the reference time constant, TIMER_Bank #1.

Next, at step 205 of FIG. 9, the resistance value of first thermistor bank 80, R_Bank#1, is calculated using the following equation:

$$\frac{\text{R_Referemce}}{\text{TIMER_Reference}} = \frac{\text{R_Bank \#1}}{\text{TIMER_Bank \#1}}$$

Where R_Reference is the known resistance value of reference resistor 89, TIMER_Reference is the mean, or average of the sixteen samples of capacitor 90 charging times with the reference resistor as discussed above, and TIMER_Bank#1 is the mean time of sixteen samples of capacitor 90 charging times with the first bank of thermistors, as discussed above. Next, the calculated resistance of R_Bank#1 is used as an index into a predetermined lookup table stored within microcontroller 60, with each potential value of R_Bank#1 having a corresponding temperature value. The lookup table entry corresponding to a resistance of R_Bank#1 is a temperature value, named TEMP_Bank#1.

Referring to FIG. 9, next, in step 206, a test is performed to determine if TEMP_Bank#1 is greater than or equal to 113 degrees centigrade. If so, an excessive temperature condition is deemed to have occurred, and transition is taken to step 220, and the apparatus is automatically shut down.

Otherwise, transition is taken to step 207, and a test is performed, to determine if TEMP_Bank#1 is less than 113 degrees centigrade and greater than or equal to 107 degrees centigrade. If so, the apparatus is considered to be in a high temperature condition, though not so high as to require a complete system shutdown. Rather, transition is taken to step 221. In step 221, referring to FIG. 4, microcontroller 60 outputs a logic low level on I/O pin 75, turning off transistor 78 and, in turn, opening relay 79. This, in turn, removes power from heating element 36, turning off the heating element.

Next, transition is taken to step 222, where a test is made to determine if TEMP_Bank#1 is less than or equal to 60 degrees centigrade. If so, transition is taken to step 208, where the system continues its normal work pattern. Otherwise, transition is taken back to step 203.

Otherwise, if TEMP_Bank#1 does not indicate either an excessive or high temperature condition, transition is taken to step 208, where the system continues its normal work pattern. Next, transition is taken to step 209.

Next, at step 209 of FIG. 9, and referring to the schematic of FIG. 4, microcontroller 60 determines a thermistor bank #2 time constant, TIMER_Bank#2, corresponding to the RC charging circuit of capacitor 90 in series with the parallel-wired bank of three thermistors in second thermistor bank 84, comprising thermistors 85, 86 and 87, thus forming an RC timing circuit. In particular, microcontroller 60 sets I/O port pin 68 to the output state, and I/O port pins 70, 71, 72, and 69 to the input state. Microcontroller 60 then activates an internal timer, and continuously monitors I/O port pin 72 while capacitor 90 charges, until a low-to-high logic level transition on this pin is observed. The value of the internal timer at the time of this transition, TIMER_Bank#2_Sample, is stored in internal memory, and the microcontroller sets I/O pins 70, 71, 72, 68 and 69 all to a logic low output level for one millisecond, to permit capacitor 90 to discharge. This operation of repeatedly charging capacitor 90 through second thermistor bank 84, timing how long it takes for a logic high level to be reached, storing this TIMER_Bank#2_Sample value in memory, and then discharging the capacitor, is repeated seventeen more times, until eighteen contiguous timer value samples are stored in the memory of Microcontroller 60. Of these eighteen timer samples, the maximum and minimum values is discarded, and the mean, or average of the remaining sixteen samples is calculated by microcontroller 60 to be the reference time constant, TIMER_Bank #2.

Next, at step 210 of FIG. 9, the resistance value of second thermistor bank 84, R_Bank#2, is calculated using the following equation:

$$\frac{\text{R_Referemce}}{\text{TIMER_Reference}} = \frac{\text{R_Bank \#2}}{\text{TIMER_Bank \#2}}$$

Where R_Reference is the known resistance value of reference resistor 89, TIMER_Reference is the mean, or average of the sixteen samples of capacitor 90 charging times with the reference resistor as discussed above, and TIMER_Bank#2 is the mean time of sixteen samples of capacitor 90 charging times with the second bank of thermistors, as discussed above. Next, the calculated resistance of R_Bank#2 is used as an index into a predetermined lookup table stored within microcontroller 60, with each potential value of R_Bank#2 having a corresponding temperature value. The lookup table entry corresponding to a resistance of R_Bank#2 is a temperature value, named TEMP_Bank#2.

Referring to FIG. 9, next, in step 211, a test is performed to determine if TEMP_Bank#2 is greater than or equal to 113 degrees centigrade. If so, an excessive temperature condition is deemed to have occurred, and transition is taken to step 223, and the apparatus is automatically shut down.

Otherwise, transition is taken to step 212, and a test is performed, to determine if TEMP_Bank#2 is less than 113 degrees centigrade and greater than or equal to 107 degrees centigrade. If so, the apparatus is considered to be in a high temperature condition, though not so high as to require a complete system shutdown. Rather, transition is taken to step 224. In step 224, referring to FIG. 4, microcontroller 60 outputs a logic low level on I/O pin 75, turning off transistor 78 and, in turn, opening relay 79. This, in turn, removes power from heating element 36, turning off the heating element. Next, transition is taken to step 225, where a test is made to determine if TEMP_Bank#2 is less than or equal to 60 degrees centigrade. If so, transition is taken to step 208, where the system continues its normal work pattern. Otherwise, transition is taken back to step 203.

Otherwise, if TEMP_Bank#2 does not indicate either an excessive or high temperature condition, transition is taken to step 213, where the system continues its normal work pattern. Next, transition is taken to step 214.

Next, at step 214 of FIG. 9, and referring to the schematic of FIG. 4, microcontroller 60 determines an ambient thermistor sensor time constant, TIMER_Ambient, corresponding to the RC charging circuit of capacitor 90 in series ambient temperature sensing thermistor 88, thus forming an RC timing circuit. In particular, microcontroller 60 sets I/O port pin 71 to the output state, and I/O port pins 70, 68, 72, and 69 to the input state. Microcontroller 60 then activates an internal timer, and continuously monitors I/O port pin 72 while capacitor 90 charges, until a low-to-high logic level transition on this pin is observed. The value of the internal timer at the time of this transition, TIMER_Ambient_Sample, is stored in internal memory, and the microcontroller sets I/O pins 70, 71, 72, 68 and 69 all to a logic low output level for one millisecond, to permit capacitor 90 to discharge. This operation of repeatedly charging capacitor 90 through ambient temperature sensing thermistor 88, timing how long it takes for a logic high level to be reached, storing this TIMER_Ambient_Sample value in memory, and then discharging the capacitor, is repeated seventeen more times, until eighteen contiguous timer samples are stored in the memory of Microcontroller 60. Of these eighteen timer samples, the maximum and minimum values is discarded, and the mean, or average of the remaining sixteen samples is calculated by microcontroller 60 to be the reference time constant, TIMER_Ambient.

Next, at step 215 of FIG. 9, the resistance value of ambient temperature sensing thermistor 88, R_Ambient, is calculated using the following equation:

$$\frac{\text{R_Referemce}}{\text{TIMER_Reference}} = \frac{\text{R_Ambient}}{\text{TIMER_Ambient}}$$

Where R_Reference is the known resistance value of reference resistor 89, TIMER_Reference is the mean time of sixteen samples of capacitor 90 charging times with the reference resistor as discussed above, and TIMER_Ambient is the mean time of sixteen samples of capacitor 90 charging times with the second bank of thermistors, as discussed above. Next, the calculated resistance of R_Ambient is used as an index into a predetermined lookup table stored within microcontroller 60, with each potential value of R_Ambient having a corresponding temperature value. The lookup table entry corresponding to a resistance of R_Ambient is a temperature value, named TEMP_Ambient.

Next, at step 216, a comparison is made, to determine if TEMP_Ambient is greater than the target temperature setting (either the default target temperature setting of 75 degrees Fahrenheit or another target temperature setting selected by the user using the control buttons in temperature setting mode). If so, transition is taken to step 226. Otherwise, transition is taken to step 217.

In step 226, referring to FIG. 4, microcontroller 60 outputs a logic low level on I/O pin 75, turning off transistor 78 and, in turn, opening relay 79. This, in turn, removes power from heating element 36, turning off the heating element. Transition is then taken back to step 203.

In step 217, a comparison is made to determine if TEMP_Ambient is equal to the target temperature setting. If so, transition is taken to step 227. Otherwise, transition is taken to step 218.

In step 227, the current output state of I/O pin 75, controlling the state of transistor 78 and, in turn, relay 79 and heating element 36, is maintained (i.e., left in its current state). Transition is then taken to step 203.

In step 218, a test is made to determine if the sensed ambient temperature has only recently fallen below the target level. If so, transition is taken to step 227. Otherwise, transition is taken to step 219.

In step 219, the sensed ambient temperature is below the target temperature, and the system is seeking to raise temperature levels. In step 219, referring to FIG. 4, microcontroller 60 initiates the output of a continuous waveform on I/O pin 75, having a frequency of approximately 1.7 KHz and a duty cycle of approximately 50%. This, in turn, repeatedly switches transistor 78 and, in turn, relay 79 on and off. This, in turn, provides power to heating element 36 on a 50% duty cycle. Transition is then taken back to step 203.

The foregoing steps are repeatedly cycled, towards achieving or maintaining a desired temperature, absent an excessively high or high temperature condition.

It will be understood that modifications and variations may be effected without departing from the spirit and scope of the present invention. It will be appreciated that the present disclosure is intended as an exemplification of the invention and is not intended to limit the invention to the specific embodiment illustrated and described. The disclosure is intended to cover, by the appended claims, all such modifications as fall within the scope of the claims.

I claim:

1. A method of sensing an overheating condition in a portable electric heater having a heating element, a reference resistor having a known resistance of R_Reference, a plurality of thermistors organized into at least a first bank of multiple thermistors and a second bank of multiple thermistors and disposed proximate the heating element in substantially evenly spaced intervals, and a capacitor, the method comprising the steps of:

placing the reference resistor in series with the capacitor to form a first RC timing circuit;

determining an amount of time TIMER_Reference that it takes for a point between the reference resistor and the capacitor to reach a predetermined threshold voltage;

switching, via a first control signal output from a microcontroller, only the first bank of multiple thermistors in series with the capacitor to form a second RC timing circuit;

determining an amount of time TIMER_BANK#1 that it takes for a point between the first bank of multiple thermistors and the capacitor to reach a predetermined threshold voltage;

determining a resistance value R_BANK#1 corresponding to the first bank of multiple thermistors using the equation:

$$\frac{\text{R_Referemce}}{\text{TIMER_Reference}} = \frac{\text{R_Bank \#1}}{\text{TIMER_Bank \#1}};$$

performing a table lookup of a first temperature value corresponding to R_BANK#1;

determining if the first temperature value is indicative of an overheating condition;

switching, via a second control signal output from the microcontroller, only the second bank of multiple thermistors in series with the capacitor to form a third RC timing circuit;

determining an amount of time TIMER_BANK#2 that it takes for a point between the second bank of multiple thermistors and the capacitor to reach a predetermined threshold voltage;

determining a resistance value R_BANK#2 corresponding to the second bank of multiple thermistors using the equation:

$$\frac{\text{R_Referemce}}{\text{TIMER_Reference}} = \frac{\text{R_Bank\#2}}{\text{TIMER_Bank\#2}};$$

performing a table lookup of a second temperature value corresponding to R_BANK#2; and determining if the second temperature value is indicative of an overheating condition.

2. The method according to claim 1, wherein the step of determining an amount of time TIMER_Bank#1 that it takes for a point between the first bank of multiple thermistors and the capacitor to reach a predetermined threshold voltage comprises the sub-steps of:

a) determining an amount of time TIMER_Bank#1_Sample that it takes for a point between the first bank of multiple thermistors and the capacitor to reach a predetermined threshold voltage;

b) storing TIMER_Bank#1_Sample in memory;

c) discharging the capacitor;

d) repeating steps a through c until a plurality of TIMER_Bank#1_Sample values are stored in memory; and e) averaging at least two of the TIMER_Bank#1_Sample values to obtain the TIMER_Bank#1 value.

3. The method according to claim 2, wherein the step of averaging at least two of the TIMER_Bank#1_Sample values to obtain the TIMER_Bank#1 value comprises the sub-steps of:

discarding a TIMER_Bank#1_Sample value having a maximum value;

discarding a TIMER_Bank#1_Sample value having a minimum value; and averaging the remaining TIMER_Bank#1_Sample values stored in memory.

4. The method according to claim 3, wherein a total of eighteen TIMER_Bank#1_Sample values are stored in memory, and a total of sixteen TIMER_Bank#1_Sample values are averaged.

5. The method according to claim 1, wherein the step of determining an amount of time TIMER_Reference that it takes for a point between the reference resistor and the capacitor to reach a predetermined threshold voltage comprises the sub-steps of:

a) determining an amount of time TIMER_Reference_Sample that it takes for a point between the reference resistor and the capacitor to reach a predetermined threshold voltage;

b) storing TIMER_Reference_Sample in memory;

c) discharging the capacitor;

d) repeating steps a through c until a plurality of TIMER_Reference_Sample values are stored in memory; and e) averaging the values of at least two of the TIMER_Reference_Sample values to obtain the TIMER_Reference value.

6. The method according to claim 5, wherein the step of averaging at least two of the TIMER_Reference_Sample values to obtain the TIMER_Reference value comprises the sub-steps of:

discarding a TIMER_Reference_Sample value having a maximum value;

discarding a TIMER_Reference_Sample value having a minimum value; and averaging the remaining TIMER_Reference_Sample values stored in memory.

7. The method according to claim 6, wherein a total of eighteen TIMER_Reference_Sample values are stored in memory, and a total of sixteen TIMER_Reference_Sample values are averaged.

* * * * *